US005111622A

United States Patent [19]

Steere, Jr.

[11] Patent Number: 5,111,622

[45] Date of Patent: May 12, 1992

[54] SLICING AND GRINDING SYSTEM FOR A WAFER SLICING MACHINE

[75] Inventor: Robert E. Steere, Jr., Boonton, N.J.

[73] Assignee: Silicon Technology Corporation, Oakland, N.J.

[21] Appl. No.: 353,879

[22] Filed: May 18, 1989

[51] Int. Cl.[5] ..... B24B 7/00

[52] U.S. Cl. ..... 51/5 C; 51/73 R; 51/34 J; 51/165.9; 51/283 R; 125/13.01

[58] Field of Search ..... 51/73 R, 235, 283 R, 51/5 C, 72 R, 74 R, 91 R, 109 R, 110 R, 121 R, 165, 85, 165.9, 34 J, 3; 125/13 R, 13.01, 13.02, 13.03

[56] References Cited

U.S. PATENT DOCUMENTS

| | | | |
|---|---|---|---|
| 3,828,758 | 8/1974 | Cary | 125/13 R |
| 4,084,354 | 4/1978 | Grandieu | 125/13.02 |
| 4,112,624 | 7/1978 | Uhtenwoldt et al. | 51/73 R |
| 4,301,624 | 11/1981 | Largeteau | 51/34 J |
| 4,399,898 | 8/1983 | Olschewski et al. | 192/85 CA |
| 4,420,909 | 12/1983 | Steere, Jr. | 51/73 R |
| 4,616,447 | 10/1986 | Haas et al. | 51/165.9 |
| 4,716,881 | 1/1988 | Steere | 51/73 R |
| 4,785,540 | 11/1988 | Underhaug | 51/165.9 |
| 4,852,304 | 8/1989 | Honda et al. | 125/13 R |

FOREIGN PATENT DOCUMENTS 3613132 4/1926 Fed. Rep. of Germany .

*Primary Examiner*—Frederick R. Schmidt
*Assistant Examiner*—Blynn Shideler
*Attorney, Agent, or Firm*—Kenyon & Kenyon

[57] ABSTRACT

A grinding wheel is mounted coaxially of an internal diameter saw blade and rotates with the saw blade during operation. The grinding wheel includes a grinding disc and a center rod which is movably mounted within a central bore of the spindle of the slicing machine. Compressed fluid such as air is used to move the grinding wheel from a retracted position to an extended position against the bias of a spring secured to the center rod. The pressurized fluid is introduced into a chamber for moving an annular sleeve-like piston removably secured to the grinding disc. An adjustable stop ring is also mounted on an adaptor within the sleeve-like piston and has ears which can be deflected by screws from access openings in the grinding disc for fine running adjustments of the grinding disc. This stop ring can be accessed upon removal of the grinding disc from the center rod and sleeve-like piston in order to permit coarse initial adjustments in the positioning of the grinding disc.

35 Claims, 4 Drawing Sheets 24
12
13
29
27
65
22
23
25
18
11
26
30'
15
3
39
50
38
38'
53
42
28
40
16
30
21
19
20
13
13
17
37
36
31
34
35
36
32
33
48
40
39
3
57
23

22
24
65
18
25
67
66
58
12
30'
60
57
59
62
64
15
61
63
61
39
48
40
52
38
49
38'
53
50
51
46
30
44
16
45
28
21
17
36
32
31
37
35
34
32
33
46
47
53
48
50
51
41
39
61
49
61
64
67
23

SLICING AND GRINDING SYSTEM FOR A WAFER SLICING MACHINE

This invention relates to a slicing and grinding system for a wafer slicing machine.

As is known, various types of structures have been used for the slicing of wafers, such as silicon wafers from ingots, for example, cylindrical ingots of silicon. For example, U.S. Pat. No. 4,420,909 describes a wafering system wherein wafers can be severed from an ingot using an internal diameter saw blade.

It has also been known that the slicing of wafers from ingots does not always produce a wafer with flat parallel front and back surfaces. Accordingly, in many cases, it has been necessary to grind one or more of the surfaces in order to obtain flat surfaces for the further processing of the wafers, for example into semi-conductor chips. To this end, various proposals have been made for grinding the ingot face prior to or simultaneously with the slicing of a wafer so that at least one face of the wafer is flat. For example, published Japanese Patent Application No. 61-106207 describes a system in which an ingot would be moved relative to a rotating cutting blade as well as a rotating grindstone so that a wafer is sliced from the ingot while being ground on one side at the same time. In an alternative embodiment, the ingot would be cut by the saw blade and thereafter the exposed face ground by a separately mounted grindstone.

German Patent application O.S. 36 13 132 describes a system wherein, after a wafer has been sliced by a saw blade, the front face of the ingot is ground by a grinding wheel which projects through the opening of the saw blade.

However, the mechanisms for actuating the grindstone are not described in Japanese Patent Application No. 61-106207 or German O.S. 36 13 132 nor are such mechanisms readily apparent.

Accordingly, it is an object of the invention to provide a slicing and grinding system for a wafer slicing machine which is of relatively simple construction.

It is another object of the invention to be able to retrofit existing slicing machines with a grind wheel.

It is another object of the invention to be able to adjust a grinding stage of a grinding and slicing machine to different thicknesses of wafers to be sliced.

It is another object of the invention to be able to adjust a grind wheel of a grinding and slicing machine in a relatively easy manner.

It is another object of the invention to incorporate a precisely controlled grind wheel in a wafer slicing machine.

It is another object of the invention to perform a reliable grinding operation in a wafer slicing machine.

Briefly, the invention provides a slicing and grinding system for a wafer slicing machine wherein a wafer slicing operation and an ingot grinding operation can be performed sequentially in a single cycle of the machine.

The wafer slicing machine includes a spindle housing and spindle of conventional construction as well as an internal diameter saw blade which is rotatably mounted on the spindle and which has a bore and an annular cutting edge about the bore for slicing a wafer from an ingot.

In accordance with the invention, an adaptor is mounted on a spindle of the machine for rotation therewith while the saw blade is mounted on the adaptor. In addition, a grind wheel is secured to the spindle for rotation therewith coaxially of the saw blade for grinding a surface of an ingot prior to slicing of a wafer therefrom. A means is also provided for moving the grind wheel coaxially of the saw blade and the spindle between a retracted position and an extended position beyond the saw blade for grinding the surface of the ingot.

The grind wheel may be constructed as a disc having a raised rim defining an annular grinding surface for grinding a leading face of the ingot and a rod which is secured to the disc and movably received in the spindle.

The means for moving the grind wheel employs an annular sleeve like piston secured to the disc of the grind wheel and received in an annular chamber in the adapter. This piston serves to guide the grind wheel between the retracted and extended positions. In addition, the means for moving the grind wheel supplies a pressurized fluid to the chamber in the adaptor in order to expel the piston so as to move the grind wheel to the extended position. The means for moving the grind wheel also includes a spring which is secured between the rod and the spindle in order to bias the rod into the spindle so as to move the grind wheel to the retracted position.

The means for supplying the pressurized fluid includes a passageway in the spindle and a second passageway between the sleeve-like piston and the adaptor which is in communication with the passageway in the spindle and the chamber. By way of example, the first passageway may be provided by a bore of the spindle which is oversized with respect to the rod of the grind wheel. Thus, the pressurized fluid may be supplied through the spindle into a chamber defined by the sleeve-like piston before passing through the second passageway into the chamber behind the piston.

The system is also provided with a stop mounted on the adaptor for abutting the sleeve-like piston in the extended position of the grind wheel. The stop is in the form of an annular stop ring which is secured to the adaptor within the piston and which includes a plurality of circumferentially spaced adjustment means for adjusting the extended position of the piston. In this respect, the grind wheel disc can be removed not only from the center rod but also from the annular sleeve-like piston so that access can be had to the stop ring. Coarse adjustments may then be made via the circumferentially spaced adjustment means so as to adjust the grind wheel via the piston to a given plane, for example, a plane parallel to the plane desired for the ground face of the ingot. Coarse adjustments may also be made to adjust the extended position of the grind wheel via the piston, for example, to accommodate different thicknesses of grind wheels and saw blades or machining tolerance variations in the grind wheel and spindle assembly. Final fine adjustments may be made with the grind wheel in place, for example, via access openings in the grind wheel disc which permit access to fine adjustment means on the stop ring.

The system may also be provided with sealing means to protect against the introduction of debris into the chamber housing the sleeve-like piston. For example, an expandable bellows seal may be provided concentrically about the piston while being secured between the grind wheel disc and the adaptor. A vent passageway may also extend from the chamber defined by the bellows seal in order to vent spent pressure fluid therefrom, for example, to the exterior of the slicing machine.

In order to protect the grind wheel in the retracted position, a protective ring is mounted concentrically about the grind wheel in the retracted position. An annular cover ring may also be secured coaxially to the periphery of the grind wheel so as to define a sealing gap with the protective ring when the grind wheel is expelled to the extended position.

In use, the slicing machine is operated such that the saw blade is moved relative to an ingot mounted on a stationary axis, such as a horizontal axis. In this respect, the saw blade moves downwardly to cut through the ingot to form a wafer of a desired thickness. A suitable pick-off mechanism is also provided to receive the severed wafer and to move the wafer through the bore (opening) in the blade, for example as described in U.S. Pat. No. 4,420,909. Next, the grind wheel is moved to the extended position an amount sufficient to move into the plane of the exposed face of the ingot ,for example, slightly below the ingot. Thereafter, as the saw blade moves upwardly, the grind wheel grinds the face of the ingot flat. Upon reaching the upper end of the movement of the saw blade, the grind wheel is retracted. At this time, the ingot can be index forwardly a predetermined amount for the subsequent slicing of a further wafer of predetermined thickness from the ingot by means of the saw blade.

In the event that a coarse adjustment is required in the extended position of the grind wheel, the grind wheel disc is removed from the center rod and the annular sleeve like piston. This exposes the adjustable stop ring which is mounted on the adaptor so that coarse adjustments can be made, for example for aligning the grind wheel into a predetermined plane relative to the face of an ingot or to adjust the amount of extension of the disk from the adaptor. After mounting of the grind wheel disc, fine adjustments may be made via the access openings therein.

These and other objects and advantages of the invention will become more apparent from the following description taken in conjunction with the accompanying drawings wherein:

FIG. 1 schematically illustrates a slicing head of a wafer slicing machine in a position after severing of a wafer from an ingot in accordance with the invention;

Figures 1, 3, 6:
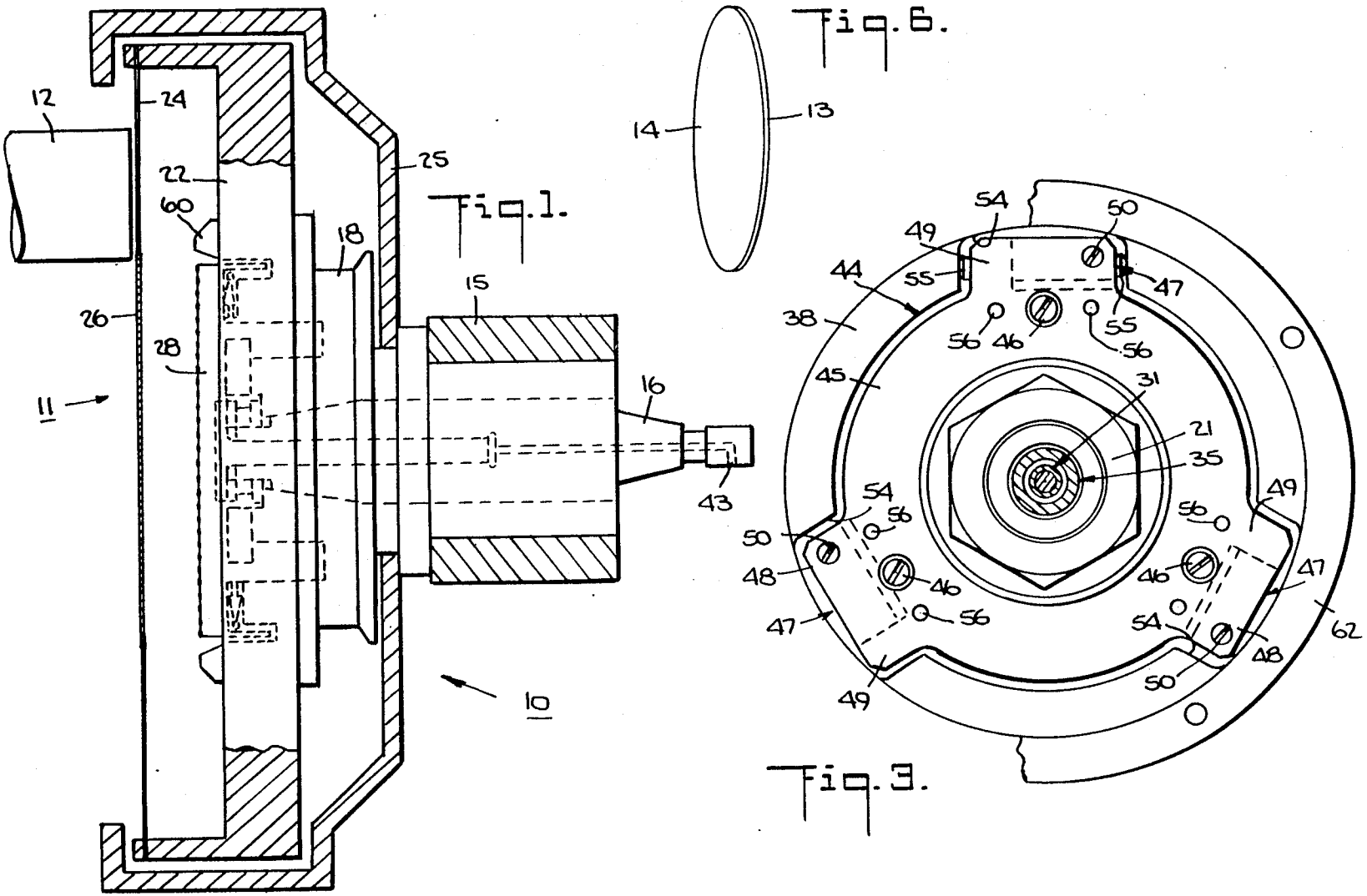
FIG. 3 illustrates a front view of an annular stop ring for adjusting the position of a grind wheel in accordance with the invention.
FIG. 6 illustrates a wafer sliced from an ingot in accordance with the invention.

Referring to FIG. 1, the wafer slicing machine 10 is provided with a slicing and grinding system 11 for slicing wafers with a ground surface from an ingot 12. In this respect, the ingot 12 is a circular ingot, for example, made of silicon.

Referring to FIG. 6, the wafer 13 sliced from an ingot 12 has a flat ground front face (not shown) and an unground back face 14.

Figure 2:
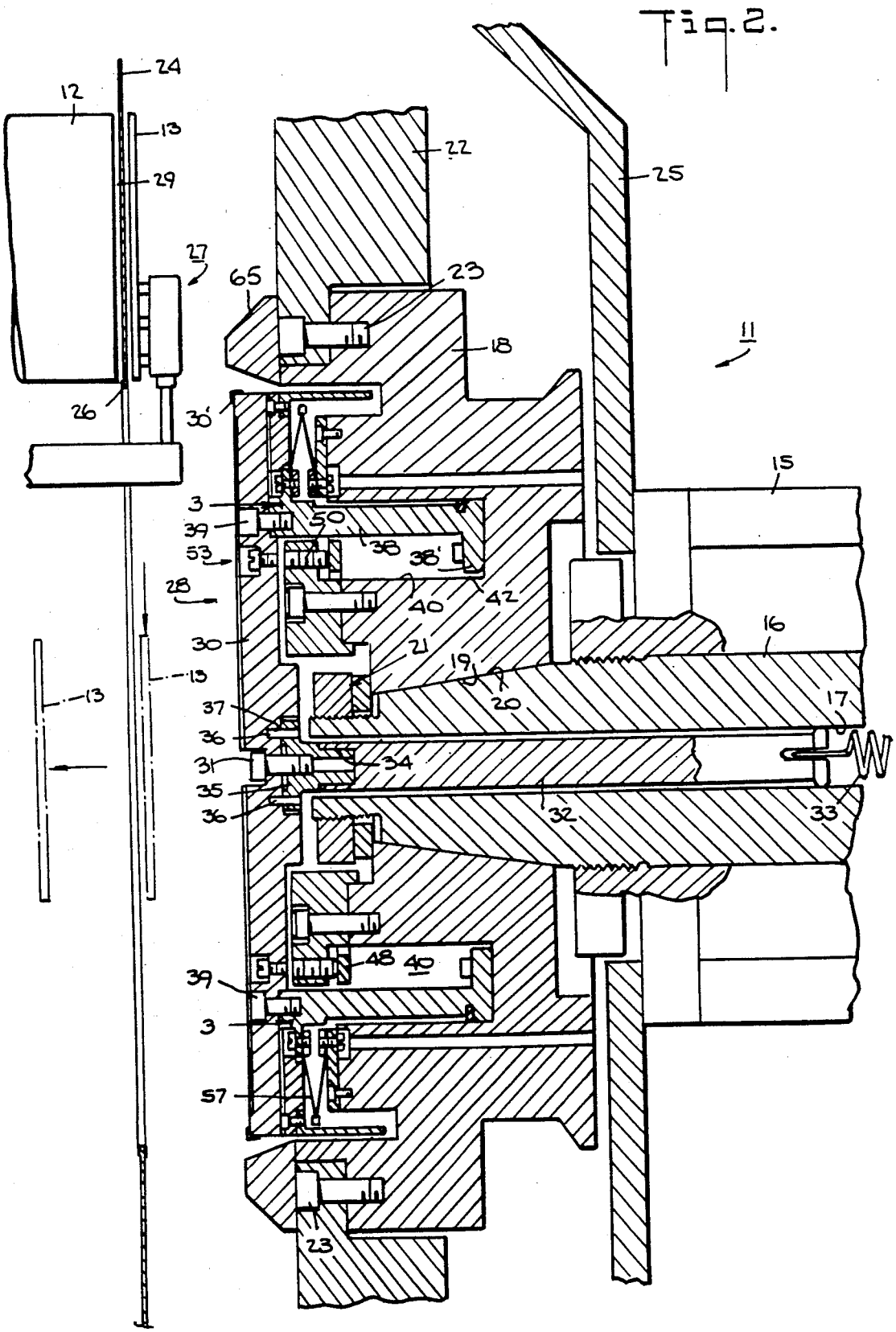
FIG. 2 illustrates a cross sectional view of a slicing and grinding system for the wafer slicing machine of FIG. 1 in accordance with the invention.

Referring to FIG. 2, the slicing and grinding system 11 includes a housing 15 in which a spindle 16 is rotatably mounted in known manner. The spindle 16 has a hollow central bore 17 disposed on a longitudinal axis and extends from the housing 15. In addition, a spindle nose adaptor 18 is mounted via a tapered bore 19 on a tapered surface 20 at the end of the spindle 16 so as to be rotatable therewith. As indicated, a lock nut and washer assembly 21 is threaded onto the end of the spindle 16 to lock the adaptor 18 in place.

A wheel head 22 is secured to the adaptor 18 as by a plurality of circumferentially distributed bolts 23. This wheel head 22, in turn, carries an internal diameter saw blade 24 in a known manner. A backing plate 25 shrouds the wheel head 22 (see FIG. 1) and extends from the front of the wheel head 22 rearwardly to the spindle housing 15 and is attached thereto.

During rotation, the spindle 16, wheel head 22 and saw blade 24 rotate in unison about the axis of the spindle 16.

In known manner, the spindle housing 15 is movable, for example, vertically as viewed in FIG. 1 relative to the ingot 12 which is, thus, mounted on a fixed horizontal axis. Suitable means (not shown) are also provided for indexing the ingot 12 forwardly into the plane of the saw blade 24. As indicated in FIG. 1, the saw blade 24 has an internal bore about which an annular cutting edge 26 is provided.

Referring to FIG. 2, a suitable pick-off assembly 27 such as described in U.S. Pat. No. 4,420,909 is provided in order to remove a wafer 13 which has been severed from the ingot 12 by the saw blade 24, for example through the bore of the saw blade 24.

A grind wheel 28 is also mounted on the spindle 16 coaxially of the saw blade 24 for rotation for grinding an exposed face 29 of the ingot 12. The grind wheel 28 includes an annular disc 30 which is removably mounted as by a bolt 31 on a central rod 32. This disc 30 has a raised rim 30' defining a grinding surface to grind the face 29 of the ingot 12. As indicated, the rod 32 is movably received in the bore 17 of the spindle 16 and is biased into the spindle 16 by a spring 33 which is secured to and between the rod 32 and the spindle 16. As shown, the rod 32 is solid and has a recess 34 at a forward end which receives a round block 35 of T-shaped cross section in fixed manner. A plurality of guide pins 36 are fixed to the block 35 and are received in blind bores 37 in the disc 30 while the bolt 31 threads into a central internally threaded bore in the block 35.

Figure 4:
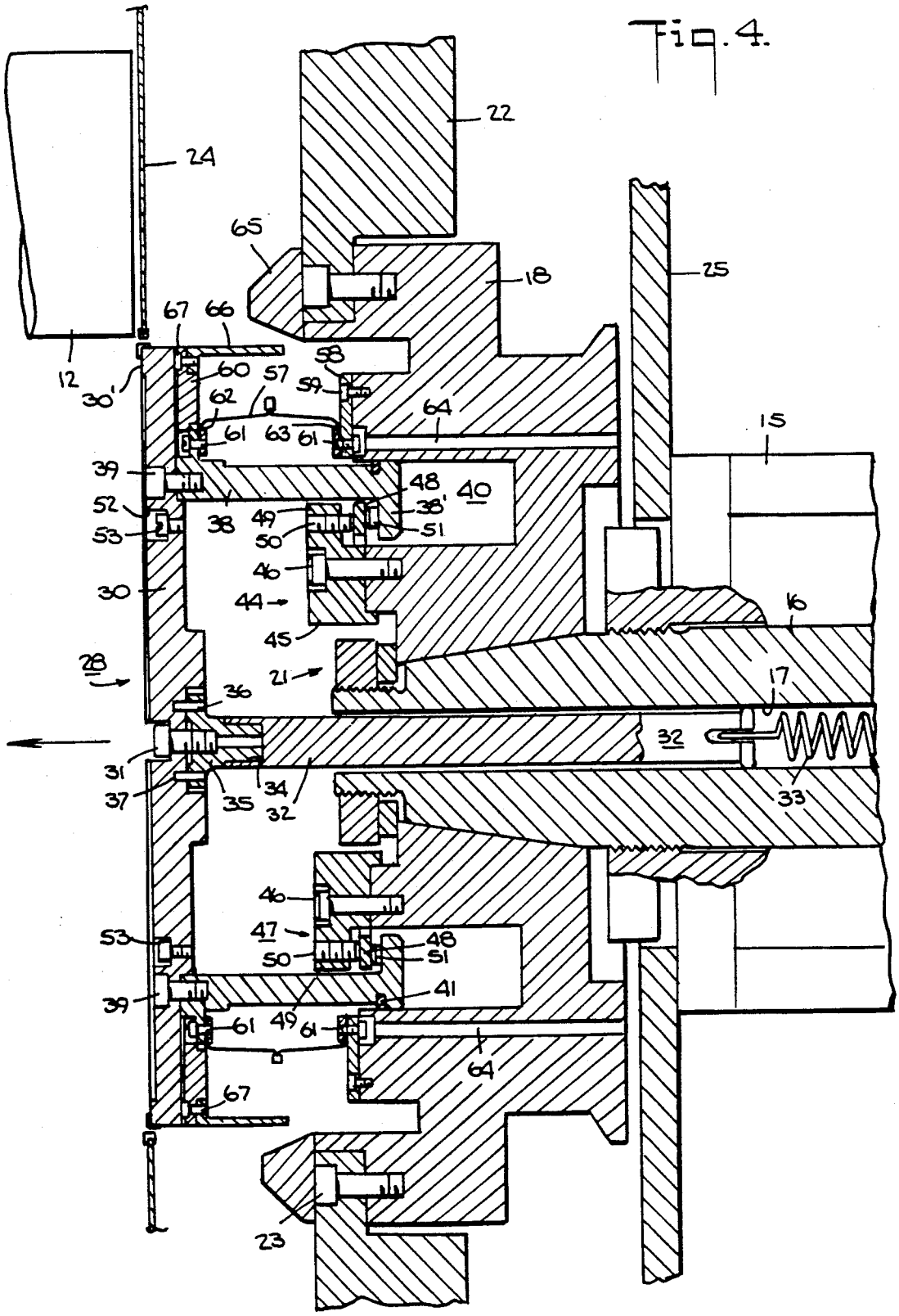
FIG. 4 illustrates a cross sectional view similar to FIG. 2 with a grind wheel in the extended position.
Figure 5:
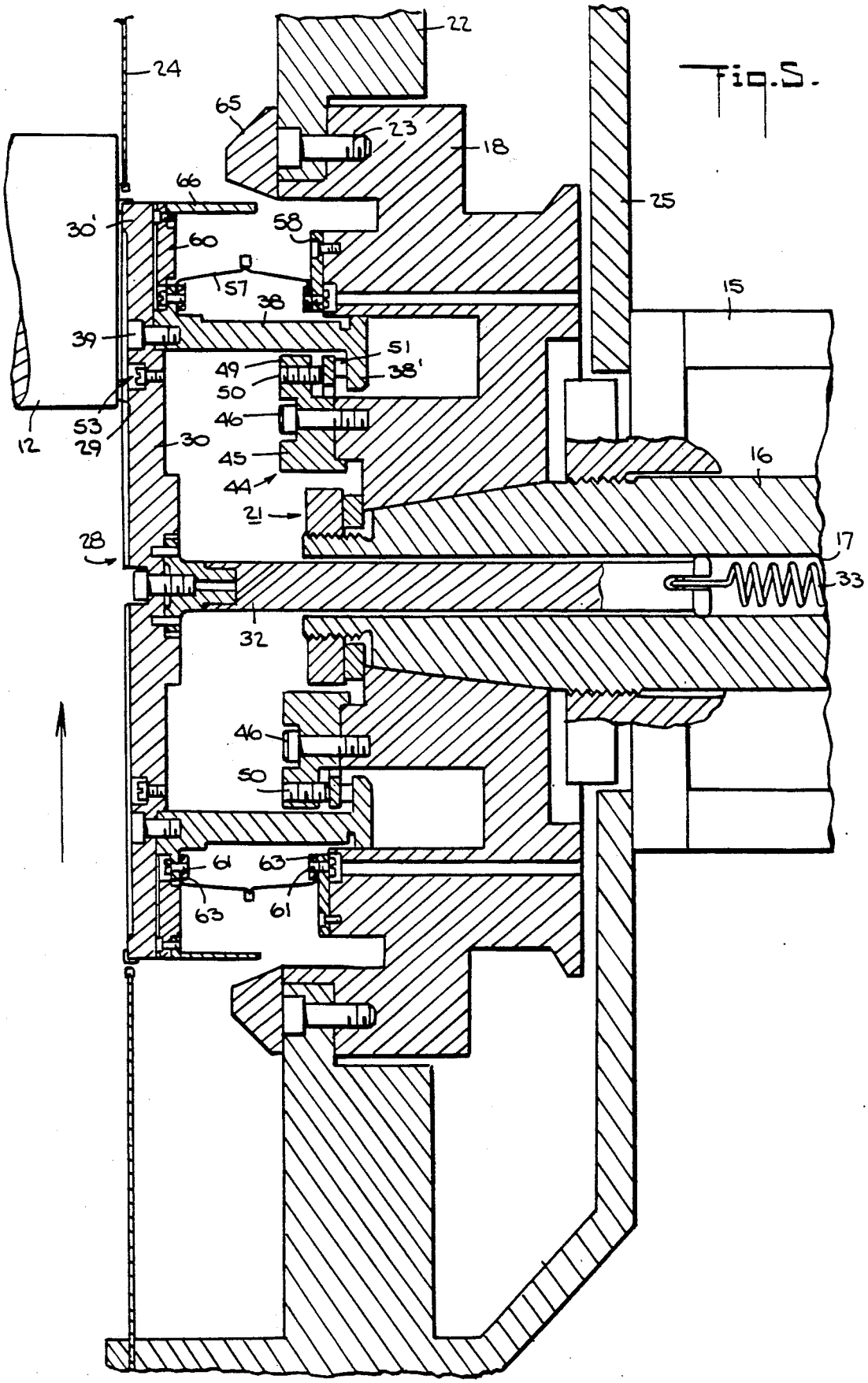
FIG. 5 illustrates a cross sectional view similar to FIGS. 2 and 4 during grinding of the face of an ingot in accordance with the invention.
Figure 5:
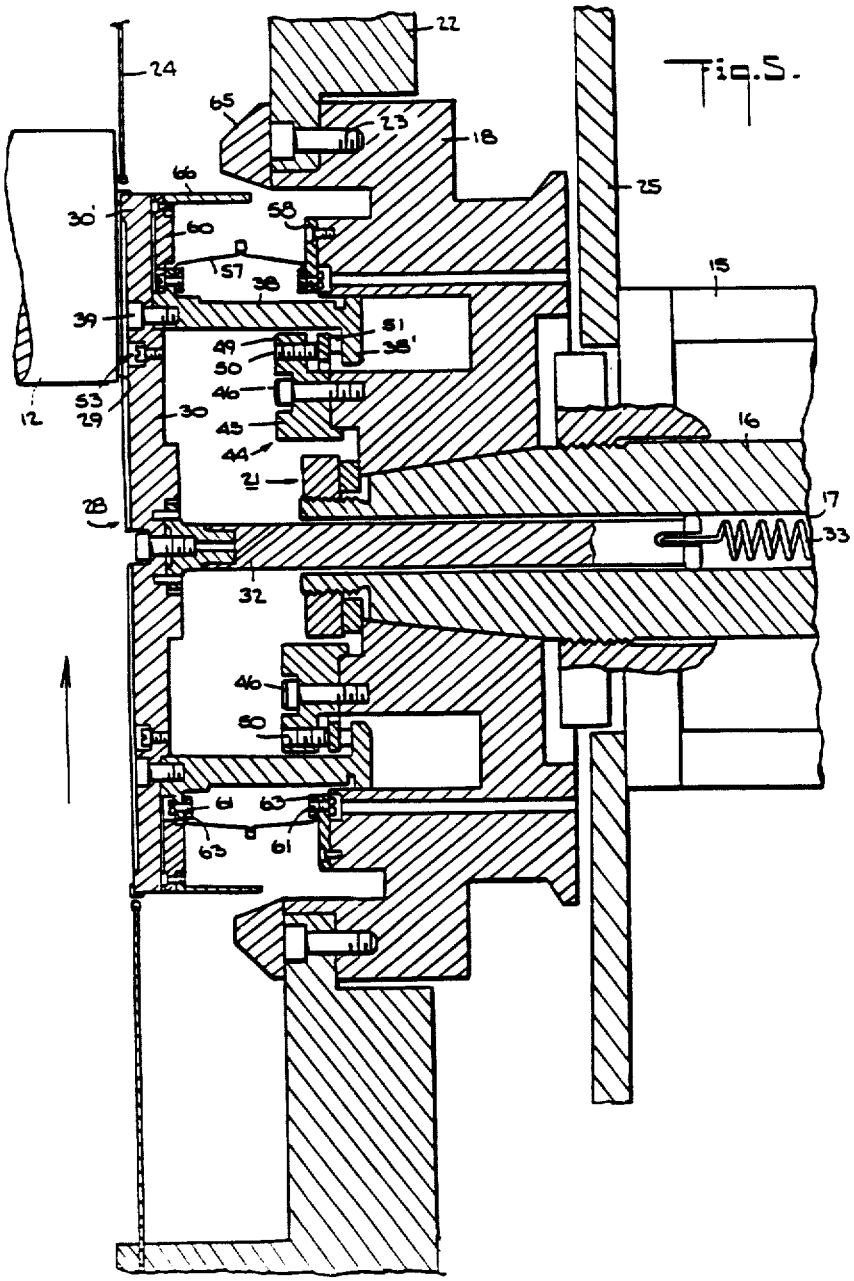

A means is also provided for moving the grind wheel 28 between a retracted position as shown in FIG. 2 and an extended position as shown in FIG. 4 for grinding the face 29 of the ingot 12. To this end, a sleeve-like piston 38 is secured as by a plurality of circumferentially disposed bolts 39 to the disc 30 and is received within an annular chamber 40 within the adaptor 18. As indicated , a seal ring 41 is provided between the outer surface of the piston 38 and the chamber 40 while an inwardly directed rim or flange 38, of the piston 38 has an innermost diameter larger than the inner diameter of the chamber 40 so as to provide a narrow gap or passageway 42 therebetween. The means for moving the grind wheel 28 includes a supply of compressed fluid such as compressed air (not shown) and an inlet connection 43 (see FIG. 1) in the spindle 16 by means of which the compressed fluid may be introduced into the internal bore 17 of the spindle 16. The bore 17 thus provides a first passageway for the compressed fluid which communicates with a chamber defined by the sleeve like piston 38. This chamber, in turn, communicates with the passageway 42 defined between the piston 38 and the chamber 40. Upon introduction of the pressurized fluid, the piston 38 is caused to move to an extended position as illustrated in FIG. 4.

Referring to FIG. 4, an adjustable stop 44 is secured to the adaptor 18 for abutting the piston 38 in the extended position. Referring to FIGS. 3 and 4, the stop 44 is in the form of an annular ring 45 which is secured to the adaptor 18 by a plurality of bolts 46 to project into the path of the inwardly directed rim 38, of the piston 38. In addition, the ring 44 has a plurality of circumferentially spaced fine adjustment means 47 for adjusting the extended position of the piston 38. In this respect, each adjustment means 47 includes an integral ear 48 which extends from a radially disposed enlarged portion 49 of the ring 45 and a threaded adjustment screw 50 which is threaded in the enlarged portion 49 into abutment with the ear 48. Thus, upon turning of the adjustment screw 50, the position of the ear 48 may be changed. For example, by threading the screw 50 into the enlargement 49, the ear 48 can be deflected into the chamber 40. Threading the screw 50 in the reverse direction permits a deflected ear 48 to return to a neutral unflexed position.

As indicated in FIG. 4, the rim portion 38' of the piston 38 is provided with a plurality of projecting stops 51 for abutting against the respective ears 48.

The grind disc 30 is provided with a plurality of access openings 52 in the form of threaded bores in which access screws 53 are provided. These openings 52 are aligned with the screws 50 in the enlarged portions 49 of the stop ring 45. Hence, upon removal of the screws 53, a tool such as a hex Allen wrench can be used to turn the screws 50 without removing the grind wheel disc 30.

As shown in FIG. 3, the piston 38 is provided with three internal longitudinal grooves 54 which terminate at the rim 38' and which guide the ears 48 therein to prevent rotation of the piston 38 relative to the ring 45. One of the enlargement portions 49 carries a projecting stop 55 on each side to abut the side walls of a groove 54.

The ring 45 is also provided with a coarse adjustment means in the form of pairs of set screws 56 at each enlargement portion 49. As indicated in FIG. 3, the set screws 56 of each pair are disposed on opposite sides of a bolt 46 to be threaded into abutment with the adaptor 18. These set screws 56 allow a coarse adjustment, i.e. axial positioning of each enlargement portion 49 and, thus, the grind wheel disc 30 relative to the adaptor 18.

Referring to FIG. 4, an expandable bellows seal 57 is disposed about the piston 38 and is secured between and indirectly to the grind wheel disc 30 and the adaptor 18. For example, the bellows seal 57 may be provided within a unit having a ring 58 secured as by screws 59 to the adaptor 18 and a cover plate 60 secured as by screws 61 to a flange 62 on the piston 38. Annular clamps 63 may also be used to secure the bellows seal 57 to the respective ring 58 and flange 62 via screws 61. As indicated, one or more passageways 64 are provided in the adaptor 18 to act as a vent passageway extending from the chamber defined by the bellows seal 57 to vent pressure fluid therefrom, for example, to a space between the wheel head 22 and the backing plate 25.

A protective ring 65 is also secured by bolts (not shown) to the wheel head 22 about the grind wheel 28. As indicated in FIG. 2, the protective ring 65 serves to protect the grinding disc 30 in a recessed manner. In addition, an annular cover ring 66 is secured as by circumferentially disposed screws 67 to the bellows cover plate 60 coaxially of the periphery of the grind wheel 28 in slightly spaced relation to the protective ring 65 in order to define a narrow sealing gap therewith. Thus, during a grinding and/or slicing operation, debris which is removed from the ingot 12 and the grind disc 30 is substantially precluded from passing between the protective ring 65 and the cover ring 66.

Referring to FIG. 2, during use, the spindle housing 15 is initially moved downwardly, as viewed, so as to effect slicing of a wafer 13 from the ingot 12 by means of the saw blade 24. After the severed wafer 13 has been removed by the pick off mechanism 27, for example, through the bore of the saw blade 24 as indicated in dotted lines, pressurized fluid is delivered through the bore 17 of the spindle 16 so as to cause the piston 28 to move from the retracted position of FIG. 2 towards and into the extended position of FIG. 4. During this time, the spindle housing 15 is retained in a stationary position.

Once the pick off mechanism 27 starts to take the severed wafer away from a holding position at the ingot 12 to a home position outside the blade 24 (not shown), the ingot 12 is indexed rearwardly away from the blade 24 a certain small distance. The ingot 12 is then indexed forwardly toward the blade 24 so that the face 29 of the ingot 12 stops a small distance in front of the blade 24. This distance is determined by the known amount that the grind wheel disc 30 extends through the bore of the blade 24 and the known amount of thickness that is to be ground from the face 29 of the ingot 12.

Thereafter, with the grind wheel 28 positioned in the bore of the blade 24 below the face of the ingot 12 and in a plane for grinding a flat face on the ingot 12, the spindle housing 15 is raised. During this time, the spindle 16 continues to rotate thus driving the grind wheel 28. The grinding surface 30' of the disc 30 then grinds the face 29 of the ingot 12 flat. In this respect, the face 29 of the ingot 12 is ground to a plane parallel to the plane in which the grinding surface 30' of the grind disc 30 moves.

Upon completion of the upward movement of the spindle housing 15, the face 29 of the ingot 12 has been ground flat. At this time, the pressurized flow of fluid into the spindle 16 ceases via suitable controls (not shown). The spindle bore 17 is then vented, for example, to atmosphere, so that the spring 33 pulls the rod 32 and thus the grind wheel 28 back into the retracted position of FIG. 2. During this time, any air which leaks out of the chamber 40 past the seal 41 is vented through the passageway 64 into the space between the wheel head 22 and backing plate 25.

Once the grind wheel 28 has been retracted a sufficient distance from the ingot 12, the ingot 12 may be indexed by suitable means (not shown) so as to move into the plane of the saw blade 24. Thereafter, the spindle housing 15 can be moved downwardly so as to conduct a further slicing operation to sever a further wafer from the ingot 12.

Thus, during one cycle of the slicing machine, a wafer is first severed from an ingot 12 and then the exposed face 29 of the ingot 12 is ground flat.

The resulting wafer 13 (see FIG. 6) thus has a front face which is ground flat and a rear face 14 which is substantially flat depending upon the slicing characteristics of the saw blade 24. Further grinding operations may be performed on this rear face 14 in other equipment (not shown) in which case, the flat front face provides a datum for the grinding operation.

In the event that a "fine running adjustment" is required in the position of the grinding disc 30, the access screws 53 in the disc 30 are removed to allow insertion of a wrench to engage the adjustment screws 50. The screws 50 may then be threaded into or out of the respective ears 48 of the ring 45 in order to carry out a fine adjustment of the position of the disc 30.

In the event that a "coarse" adjustment the in position of the disc 30 is required during initial installation and assembly of the grind wheel system and as required subsequently, the disc 30 is removed from the stabilizing rod 32 and the piston 38 by unthreading of the respective bolts 31, 39. This exposes the stop ring 45, for example, as indicated in FIG. 3. The "coarse" adjustment screws 56 may then be threaded in or out in concert with the bolts 46 to carry out a "coarse" adjustment of the disc 30 via the piston 38. Thereafter, the disc 30 can be secured in place on the round block 35 part of pull rod 32 and the piston 38.

The invention thus provides a slicing and grinding system for a wafer slicing machine which can be readily adapted to the slicing and grinding of wafers of different thicknesses.

Further, the invention provides a grinding system for a slicing machine which can be readily adjusted from time-to-time so as to adjust the plane of the grinding disc.

Further, the invention provides a grinding assembly which can be readily retrofitted onto existing wafer slicing machines.

What is claimed is:

1. A slicing and grinding system for a wafer slicing machine, said system comprising a rotatable spindle an internal diameter saw blade rotatably mounted on said spindle, said blade having a bore and an annular cutting edge about said bore for slicing a wafer from an ingot;

a grind wheel rotatably mounted on said spindle coaxially of said blade for grinding a surface of an ingot prior to slicing of a wafer therefrom; and means for moving said grind wheel coaxially of said saw blade between a retracted position and an extended position for grinding the surface of an ingot, said means including an annular piston secured to said grind wheel, an annular chamber slidably receiving said piston and passageway means for delivering a pressurized fluid to said chamber for expelling said piston therefrom.

2. A slicing and grinding system as set forth in claim 1 wherein said grind wheel includes a disc having a raised rim defining an annular grinding surface.

3. A slicing and grinding system as set forth in claim 2 further comprising a rod coaxially secured to said disc and movably mounted in said spindle.

4. A slicing and grinding system as set forth in claim 3 wherein said means includes a spring secured to said rod and biasing said rod into said retracted position.

5. A slicing and grinding system as set forth in claim 1 which further comprises a seal ring between an outer surface of said piston and said chamber.

6. A slicing and grinding system as set forth in claim 1 which further comprises an adjustable stop for abutting said piston in said extended position.

7. A wafer slicing machine comprising a spindle having a central bore;

an adaptor mounted on said spindle and including an annular chamber coaxial of said bore;

a grind wheel secured to said spindle for rotation therewith, said wheel having a disc for grinding a leading face of an ingot and a rod secured to said disc and movably received coaxially within said bore for movement of said disc between an extended position for grinding an ingot and a retracted position;

an annular sleeve-like piston secured to said disc and slidably received in said chamber; and means for supplying a pressurized fluid to said chamber to expel said piston therefrom to move said disc to said extended position.

8. A wafer slicing machine as set forth in claim 7 which further comprises a spring secured between said rod and said spindle to bias said disc into said retracted position.

9. A wafer slicing machine as set forth in claim 7 wherein said means includes a first passageway in said spindle and a second passageway between said piston and said adaptor in communication with said first passageway on said chamber.

10. A wafer slicing machine as set forth in claim 7 which further comprises a stop mounted on said adaptor for abutting said piston in said extended position.

11. A wafer slicing machine as set forth in claim 10 wherein said stop is adjustable relative to said adaptor to provide a coarse adjustment to establish said extended position.

12. A wafer slicing machine as set forth in claim 11 wherein said stop includes an annular stop ring having at least one radially disposed enlarged portion, an ear integral with and extending from said portion and an adjustment screw threaded in said portion into abutment with said ear to deflect said ear towards said piston.

13. A wafer slicing machine as set forth in claim 12 wherein said grind wheel disc has at least one access opening aligned with said screw to permit passage of a tool for fine adjustment of said grind wheel disc.

14. A wafer slicing machine as set forth in claim 7 which further comprises an expandable bellows seal between said disc and said adaptor coaxially about said sleeve-like piston, said seal defining a second chamber about said piston.

15. A wafer slicing machine as set forth in claim 14 which further comprises a vent passageway in said adaptor extending from said second chamber to vent pressure fluid therefrom.

16. A slicing and grinding system for a wafer slicing machine, said system comprising a housing;

a spindle rotatably mounted in said housing;

an adaptor mounted on said spindle;

an internal diameter saw blade mounted on said adaptor for rotation relative to said housing;

a grind wheel secured to said spindle coaxially of said saw blade for rotation therewith to grind the surface of an ingot; and means between said grind wheel and said spindle for moving said grind wheel coaxially of said saw blade and said spindle between a retracted position and an extended position beyond said blade for grinding the surface of an ingot.

17. A system as set forth in claim 16 wherein said means comprises an annular sleeve-like piston secured to said grind wheel and an annular chamber in said adaptor coaxially of said spindle receiving said piston for guiding of said wheel between said positions.

18. A wafer slicing machine as set forth in claim 17 wherein said means supplies a pressurized fluid to said chamber to expel said piston therefrom to move said wheel to said extended position.

19. A wafer slicing machine as set forth in claim 18 wherein said means includes a first passageway in said spindle for conveying fluid and a second passageway between said piston and with said adaptor in communication with said first passageway and said chamber.

20. A wafer slicing machine as set forth in claim 19 wherein said grind wheel includes a disc for grinding a leading face of an ingot and a rod secured to said disc and movably received in said first passageway of said spindle.

21. A wafer slicing machine as set forth in claim 20 wherein said means includes a spring secured between said rod and said spindle to bias said rod into said spindle to move said wheel to said retracted position.

22. A wafer slicing machine as set forth in claim 17 which further comprises an expandable bellows seal between said wheel and said adaptor and coaxially about said piston.

23. A wafer slicing machine as set forth in claim 16 which further comprises a stop mounted on said adaptor for abutting said piston in said extended position.

24. A wafer slicing machine as set forth in claim 23 wherein said stop is adjustable relative to said adaptor to provide a coarse adjustment to establish said extended position.

25. A wafer slicing machine as set forth in claim 24 wherein said stop includes an annular stop ring having at least one radially disposed enlarged portion, an ear integral with and extending from said portion into abutment with said ear to deflect said ear towards said piston.

26. A wafer slicing machine as set forth in claim 25 wherein said grind wheel disc has at least one access opening aligned with said screw to permit passage of a tool for fine adjustment of said grind wheel disc.

27. A wafer slicing machine as set forth in claim 16 which further comprises a protective ring secured to said adaptor concentrically about said grind wheel in said retracted position.

28. A wafer slicing machine as set forth in claim 27 which further comprises an annular cover ring secured coaxially to a periphery of said grind wheel and spaced from said protective ring to define a sealing gap therewith.

29. A wafer slicing machine as set forth in claim 16 wherein said grind wheel includes a disc for grinding a leading face of a ingot and a rod movably received in said spindle.

30. A wafer slicing machine as set forth in claim 29 which further comprises a stop mounted on said adaptor for abutting said piston in said extended position.

31. A wafer slicing machine as set forth in claim 30 wherein said stop is adjustable relative to said adaptor to provide an adjustment to establish said extended position.

32. A wafer slicing machine as set forth in claim 17 wherein said grind wheel includes a rod movably received in said spindle and a grinding disc removably secured to said rod.

33. A wafer slicing machine as set forth in claim 32 which further comprises an annular sleeve-like piston removably secured to said disc and slidably received in an annular chamber of said adaptor and an annular stop ring secured to said adaptor within said piston for abutting said piston in said extended position.

34. A wafer slicing machine as set forth in claim 33 wherein said stop ring includes a plurality of circumferentially spaced adjustment means for adjusting said extended piston.

35. A slicing and grinding system for a wafer slicing machine, said system comprising a housing;

a spindle rotatably mounted on said housing;

an adaptor mounted on said spindle an internal diameter saw blade mounted on said adaptor for rotation relative to said housing;

a grind wheel secured to said spindle coaxially of said saw blade for rotation therewith to grind the surface of an ingot;

means for moving said grind wheel coaxially of said saw blade and said spindle between a retracted position and an extended position beyond said blade for grinding the surface of an ingot; and a protective ring secured to said adaptor concentrically about said grind wheel in said retracted position.

* * * * *

UNITED STATES PATENT AND TRADEMARK OFFICE

CERTIFICATE OF CORRECTION

PATENT NO. : 5,111,622

DATED : May 12, 1992

INVENTOR(S) : ROBERT E. STEERE, JR.

It is certified that error appears in the above-indentified patent and that said Letters Patent is hereby corrected as shown below:

IN THE DRAWINGS

Delete Drawing Sheet 4, and substitute therefor the Drawing Sheet consisting of Fig. 4, as shown on the attached page.

ON THE TITLE PAGE

The Title page, showing an illustrative figure, should be deleted and substitute therefor the attached title page.

Signed and Sealed this

Twenty-ninth Day of March, 1994

*Attest:*

Bruce Lehman

BRUCE LEHMAN

*Attesting Officer*

*Commissioner of Patents and Trademarks*

US005111622A

United States Patent [19]

Steere, Jr.

[11] Patent Number: 5,111,622

[45] Date of Patent: May 12, 1992

[54] SLICING AND GRINDING SYSTEM FOR A WAFER SLICING MACHINE

[75] Inventor: Robert E. Steere, Jr., Boonton, N.J.

[73] Assignee: Silicon Technology Corporation, Oakland, N.J.

[21] Appl. No.: 353,879

[22] Filed: May 18, 1989

[51] Int. Cl.[5] ..... B24B 7/00

[52] U.S. Cl. ..... 51/5 C; 51/73 R; 51/34 J; 51/165.9; 51/283 R; 125/13.01

[58] Field of Search ..... 51/73 R, 235, 283 R, 51/5 C, 72 R, 74 R, 91 R, 109 R, 110 R, 121 R, 165, 85, 165.9, 34 J, 3; 125/13 R, 13.01, 13.02, 13.03

[56] References Cited

U.S. PATENT DOCUMENTS

| | | | |
|---|---|---|---|
| 3,828,758 | 8/1974 | Cary | 125/13 R |
| 4,084,354 | 4/1978 | Grandieu | 125/13.02 |
| 4,112,624 | 7/1978 | Uhtenwoldt et al. | 51/73 R |
| 4,301,624 | 11/1981 | Largeteau | 51/34 J |
| 4,399,898 | 8/1983 | Olschewski et al. | 192/85 CA |
| 4,420,909 | 12/1983 | Steere, Jr. | 51/73 R |
| 4,616,447 | 10/1986 | Haas et al. | 51/165.9 |
| 4,716,881 | 1/1988 | Steere | 51/73 R |
| 4,785,540 | 11/1988 | Underhaug | 51/165.9 |
| 4,852,304 | 8/1989 | Honda et al. | 125/13 R |

FOREIGN PATENT DOCUMENTS 3613132 4/1926 Fed. Rep. of Germany .

*Primary Examiner*—Frederick R. Schmidt
*Assistant Examiner*—Blynn Shideler
*Attorney, Agent, or Firm*—Kenyon & Kenyon

[57] ABSTRACT

A grinding wheel is mounted coaxially of an internal diameter saw blade and rotates with the saw blade during operation. The grinding wheel includes a grinding disc and a center rod which is movably mounted within a central bore of the spindle of the slicing machine. Compressed fluid such as air is used to move the grinding wheel from a retracted position to an extended position against the bias of a spring secured to the center rod. The pressurized fluid is introduced into a chamber for moving an annular sleeve-like piston removably secured to the grinding disc. An adjustable stop ring is also mounted on an adaptor within the sleeve-like piston and has ears which can be deflected by screws from access openings in the grinding disc for fine running adjustments of the grinding disc. This stop ring can be accessed upon removal of the grinding disc from the center rod and sleeve-like piston in order to permit coarse initial adjustments in the positioning of the grinding disc.

35 Claims, 4 Drawing Sheets

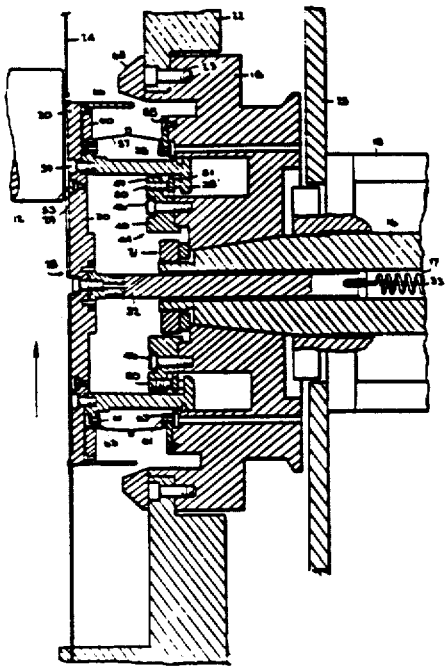

22
24
65
23
18
66
25
30'
60
58
57
38
15
39
51
49
38'
50
46
53
29
30
45
16
12
44
21
17
28
33
32
46
60
61
63
63
61